US009691511B1

(12) United States Patent
Coats et al.

(10) Patent No.: US 9,691,511 B1
(45) Date of Patent: Jun. 27, 2017

(54) TARGET-FUELED NUCLEAR REACTOR FOR MEDICAL ISOTOPE PRODUCTION

(75) Inventors: Richard L. Coats, Albuquerque, NM (US); Edward J. Parma, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 1538 days.

(21) Appl. No.: 12/845,497

(22) Filed: Jul. 28, 2010

Related U.S. Application Data

(60) Provisional application No. 61/259,259, filed on Nov. 9, 2009.

(51) Int. Cl.
*G21G 1/02* (2006.01)

(52) U.S. Cl.
CPC ..... *G21G 1/02* (2013.01)

(58) Field of Classification Search
USPC ..... 376/172, 173, 186, 189
See application file for complete search history.

(56) References Cited

U.S. PATENT DOCUMENTS 3,799,883 A * 3/1974 Arino et al. ..... 252/645
3,998,691 A * 12/1976 Shikata et al. ..... 376/169
5,295,169 A * 3/1994 Tominaga et al. ..... 376/293
5,596,611 A * 1/1997 Ball ..... 376/189
6,512,805 B1 * 1/2003 Takeda et al. ..... 376/171
2008/0159463 A1 * 7/2008 Ortega et al. ..... 376/269

OTHER PUBLICATIONS

Parma, E.J., "Sandia National Laboratories Medical Isotope Reactor Concept," Sania Report SAND2010-1816 printed Apr. 2010, approved for public Unlimited Release.
Coats, R., "A Small, Passively Safe Mo-99 Isotope Production Reactor to Meet the U.S. Demand," Nuclear Research Reactors: U , Sandia National Laboratories, rlcoats@sandia.gov.
Committee on "Medical Isotope Production without Highly Enriched Uranium," The National Academies Press, Washington, DC 20055, http://www.nap.edu, Copyright 2009 by NAS.
Coats, R., "Requirements for a Commercial-Scale Domestic Mo-99 Supply," Nuclear Research Reactors: Utilizations and Applications , Sandia National Labs, rlcoats@sandia.gov.

* cited by examiner

*Primary Examiner* — Sean P Burke
(74) *Attorney, Agent, or Firm* — Kevin W. Bieg

(57) ABSTRACT

A small, low-enriched, passively safe, low-power nuclear reactor comprises a core of target and fuel pins that can be processed to produce the medical isotope $^{99}$Mo and other fission product isotopes. The fuel for the reactor and the targets for the $^{99}$Mo production are the same. The fuel can be low enriched uranium oxide, enriched to less than 20% $^{235}$U. The reactor power level can be 1 to 2 MW. The reactor is passively safe and maintains negative reactivity coefficients. The total radionuclide inventory in the reactor core is minimized since the fuel/target pins are removed and processed after 7 to 21 days.

21 Claims, 8 Drawing Sheets

Natural Circulation for
Fuel/Target Cooling

TARGET-FUELED NUCLEAR REACTOR FOR MEDICAL ISOTOPE PRODUCTION

CROSS-REFERENCE TO RELATED APPLICATION

This application claims the benefit of U.S. Provisional Application No. 61/259,259, filed Nov. 9, 2009, which is incorporated herein by reference.

STATEMENT OF GOVERNMENT INTEREST

This invention was made with Government support under contract no. DE-AC04-94AL85000 awarded by the U. S. Department of Energy to Sandia Corporation. The Government has certain rights in the invention.

FIELD OF THE INVENTION

The present invention relates to medical isotopes and, in particular, to a target-fueled nuclear reactor for medical isotope production.

BACKGROUND OF THE INVENTION

The metastable radioisotope $^{99m}$Tc, which results from the radioactive decay of $^{99}$Mo, is used in over 20 million nuclear medicine procedures performed annually in the United States. $^{99m}$Tc is especially useful for such procedures because it can be chemically incorporated into small molecule ligands and proteins that concentrate in specific organs or tissues when injected into the body, enabling a variety of clinical diagnostic and therapeutic applications. The isotope has a half-life of about six hours and emits a 143 keV gamma that can be efficiently detected by scintillation cameras. This short half-life also reduces the amount of time the isotope resides in the body and minimizes radiation dose to other undiseased parts of the body.

$^{99m}$Tc is currently produced through a multistep process that begins with the neutron irradiation of fissile $^{235}$U contained in uranium-bearing targets to produce $^{99}$Mo in a nuclear reactor. Following irradiation, the targets are chemically processed to separate $^{99}$Mo from other fission products, including $^{131}$I and $^{133}$Xe. The separated $^{99}$Mo, which is contained in a solution, is then adsorbed onto an alumina ($Al_2O_3$) column that is contained in small cylinders. The columns are shipped to radiopharmacies and hospitals in radiation-shielded technetium generators. The $^{99m}$Tc is typically recovered from the generator by elution of the column with a saline solution. A technetium generator can be eluted several times a day for about a week before it needs to be replaced with a fresh generator. However, because of its relatively short 66-hour half-life, $^{99}$Mo cannot be stockpiled for use. It must be made on a weekly or more frequent basis to ensure continuous availability. Therefore, any interruption in the production, transport, or delivery of $^{99}$Mo or technetium generators can have substantial impacts on patient care.

Nuclear reactors provide an efficient source of low-energy neutrons for $^{99}$Mo production from fission in $^{235}$U-bearing targets. The amount of $^{99}$Mo produced in a target is a function of irradiation time, the thermal neutron fission cross section for $^{235}$U, the thermal neutron flux on the target, the mass of $^{235}$U in the target, and the half-life of $^{99}$Mo. The target must be properly sized to fit into the irradiation position inside the reactor, contain a sufficient amount of $^{235}$U to produce the required amount of $^{99}$Mo when it is irradiated (approximately 6% of the $^{235}$U fission fragments are $^{99}$Mo atoms), have good heat transfer properties to prevent overheating and target failure during irradiation, provide a barrier to the release of radioactive products, especially fission gases, during and after irradiation, and comprise target materials that are compatible with the chemical processing steps that are used to recover and purify $^{99}$Mo from the irradiated target. Targets can typically be shaped as plates, pins, or cylinders and be made of uranium metal, uranium oxides, or uranium alloys. The fissionable material is typically encapsulated in a cladding to protect the chemically reactive uranium metal or alloy and to contain the fission products produced during irradiation.

Currently, the vast majority of $^{99}$Mo produced in the world is by the irradiation of highly enriched uranium targets (HEU, ~93% $^{235}$U). Driver reactor cores operating at tens to hundreds of megawatts produce a high neutron flux in an irradiation region where targets, using HEU as fuel, are irradiated continuously for about a week to achieve near-maximum $^{99}$Mo production in the targets while meeting quality requirements. Irradiation times must be short (7 to 21 days) to control quality in purity levels and specific activity. After irradiation, the targets are transferred and processed at a hot cell facility to separate the $^{99}$Mo product isotope. The waste stream, including the uranium, is then stored for decay and disposed of at a later date. Currently, target fuel is not reprocessed.

HEU irradiation gives the highest production efficiency and the lowest mass of waste materials to store and to ultimately dispose. However, the use of HEU raises concerns about nuclear proliferation and, therefore, the continued availability of HEU for $^{99}$Mo production. In particular, nonproliferation security issues are pressuring a change from HEU to low enriched uranium (LEU, less than about 20% $^{235}$U) for reactors and targets. However, the use of LEU introduces more difficulty in irradiation, processing, and radioactive waste management and may lead to serious reactor and target issues. For example, fuel replacement may not be compatible with balance of plant and use of LEU may require more irradiation space for increased target mass and target cooling. The change from HEU to LEU may also raise process and quality issues, such as increased uranium process and waste mass, and increased $\alpha$-emitter production can become a problem for long irradiation times and/or hard spectrum systems. See "Medical Isotope Production without Highly Enriched Uranium," National Research Council (2009).

The current fleet of nuclear reactors throughout the world that produce $^{99}$Mo from the fission process are aging and cannot meet the world demand. Further, the current high-flux reactors used for production are owned by government agencies or universities and are not operated for the sole purpose of producing $^{99}$Mo. Therefore, the true cost for the production of $^{99}$Mo becomes difficult to ascertain since these reactors are subsidized in the costs of operation, maintenance, and refueling. Further, the demands of other customers, in addition to the production of $^{99}$Mo, cause conflicts in scheduling of these multi-use reactors.

There is clearly a need for a domestic (U.S.) supply of $^{99}$Mo/$^{99m}$Tc for the nation's medical community. Current $^{99}$Mo consumption in the U.S. is about 6000 six-day Curies (Ci) per week. Production of 6,000 six-day Ci per week requires at least 1.1 MW of continuous target fission power, assuming two post-irradiation days for processing and shipping. The U.S. has depended on imports primarily from Canada which, except for a few short interruptions, have been quite reliable in the past. The National Research Universal (NRU) reactor at Chalk River, Canada is used to irradiate targets containing HEU. However, recently this source has become unreliable, due to planned and unplanned outages and aging reactors. In the U.S., there has been no domestic supply of $^{99}$Mo since Cintichem operations ceased in the late 80's. In the mid 90's the Department of Energy (DOE) undertook an effort to provide a domestic supply of $^{99}$Mo to be used, primarily, as a back-up to the Canadian supply. However, in anticipation of the Canadian Maple reactors, the DOE effort was terminated in the late 90's. Unfortunately, the Maple reactors effort was plagued with licensing and technical problems, and was therefore terminated in 2008. Therefore, there currently is no domestic or long-term backup supply for $^{99}$Mo production.

The most cost effective approach to meeting the domestic $^{99}$Mo demand is to construct a reactor system and an adjacent chemical processing facility whose sole purpose is the production of medical isotopes. Therefore, a need remains for a simple straightforward reactor and facility design concepts that can satisfy all requirements and constraints for production of sufficient $^{99}$Mo to meet domestic U.S. demand using low-enriched uranium fuel.

SUMMARY OF THE INVENTION

The present invention is directed to a target-fueled nuclear reactor for production of the medical isotope $^{99}$Mo and other radioisotopes using the fission process. The invention uses a small, low-enriched, passively safe, low-power nuclear reactor, by which the uranium pins making up the core are processed to produce the medical isotope $^{99}$Mo and other fission product isotopes.

The target-fueled nuclear reactor uses an all target reactor core, that is, no separate driver core is required to irradiate targets. Therefore, fuel and targets are one in the same. The fuel/targets comprise LEU, which alleviates proliferation risks and concerns. The quantity of $^{99}$Mo produced is directly proportional to the power attainable in the fuel pins. The target-fueled nuclear reactor is cost effective since no large, costly driver core is required to be operated, maintained, and refueled.

The target-fueled nuclear reactor uses a passively safe reactor design. All reactivity coefficients are negative. The fuel pins achieve criticality and the reactor power is controlled using control rods and a control system similar to low-power research reactors (on the order of 1 to 2 MW). Loss of power shuts down the reactor by dropping electromagnetically-coupled control and safety rods. No standby or backup power supplies are required for cooling or control. The reactor can use natural convection cooling of the core. The pool water can be cooled using a secondary heat exchanger and a small cooling tower. No active cooling system is required for decay cooling. No emergency core cooling is required. The pool water, in addition to providing cooling, serves as shielding for personnel and will retain radionuclides in the event of a fuel pin leak or cladding failure.

The fuel configuration can be annular to permit a cylindrical central structure to house control rods, to further improve the uniformity of pin power and to facilitate automation of the fuel extraction and replacement. The fuel region can be adjustably reflected radially and/or axially, to minimize the pin inventory, to ensure adequate uniformity of pin power, and to allow for reactivity adjustments. Pin spacing can be selected to ensure robust negative reactivity feedback. The grid can contain extra pin spaces to allow for other targets, designed for the production of other isotopes, for reactivity adjustments, and for increased $^{99}$Mo production in response to market demand.

The reactor active core region can be a small size with a small number of fuel pins. For example, approximately 90 to 150 LEU oxide fuel pins, about 1 cm in diameter and about 30 to 40 cm in height, can be used to achieve criticality. Therefore, core size can be roughly 30 cm in diameter by 30 to 40 cm in height. The pins serve as the $^{99}$Mo targets and, if operated with an average pin power of 8 to 10 kW, can meet the required ~1.1 MW of target power for 100% of the domestic demand for $^{99}$Mo. If operated at a higher power level or with a greater number of fuel pins, the production would be greater than the domestic demand.

An adjacent hot cell facility can be connected to the reactor pool by a water channel to facilitate remote transfer of irradiated targets for processing. Fuel pins can be removed from the core individually or in groups on a daily basis for processing at the co-located hot cell facility using the well-developed Cintichem or other separation processes. The frequency and number of pins processed can depend on the demand for the isotope. The removed fuel pins can be replaced in the core with fresh fuel pins and the reactor can be restarted and operated at full power until the next removal cycle. Fission product inventory is low due to low power and the regular processing of the reactor core.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

DETAILED DESCRIPTION OF THE INVENTION

Figure 1:
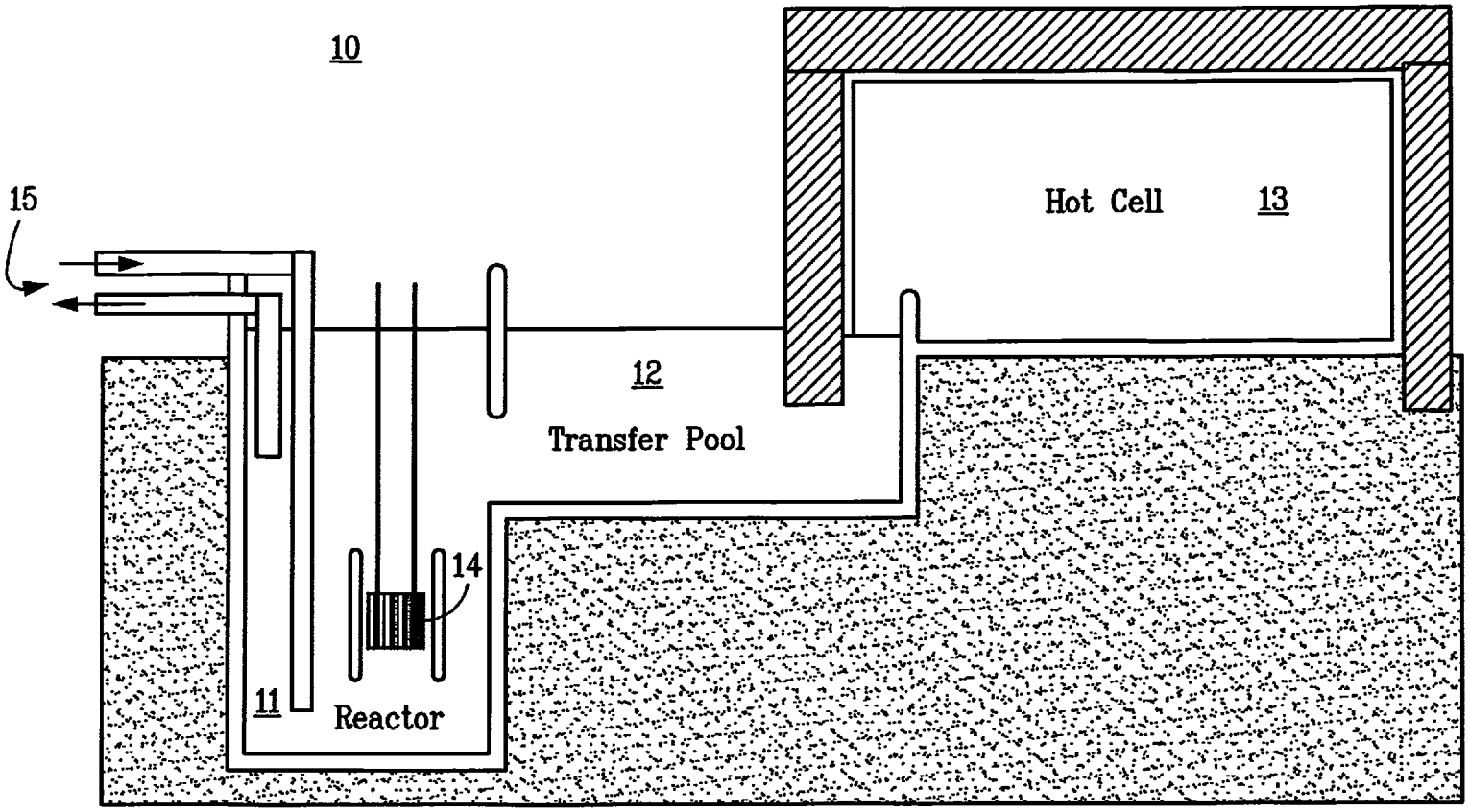
FIG. 1 is a schematic illustration of a target-fueled reactor facility for medical isotope production.

A reactor-induced fission process is currently the only viable supply option to meet the U.S. demand for $^{99}$Mo production. A domestic demand of 5000 to 7000 (6 day) curies per week translates to 38,000 to 53,000 production curies per week, allowing two days for processing and shipping. For a fission source, this production requirement translates to about 1.1 MW of continuous fission power in the targets, assuming a seven-day target irradiation, daily target removal, and two days for processing and shipping. Therefore, the specific activity must be greater than 1000 to 5000 Ci ($^{99}$Mo) per gram of molybdenum, or a generator load concentration of greater than 350 Ci/liter. Additionally, impurity levels for medical isotopes must be kept low for patient protection. In particular, the impurity levels for individual gamma emitters (e.g., $^{131}I$, $^{103}Ru$, $^{132}Te$, $^{112}Pd$) must be kept below about $5\times10^{-5}$ Ci/Ci ($^{99}Mo$), impurity levels for individual beta emitters (e.g., $^{89}Sr$ and $^{90}Sr$) must be kept below about $1\times10^{-8}$ Ci/Ci ($^{99}Mo$), and impurity levels for total alpha emitters must be kept below about $1\times10^{-10}$ Ci/Ci ($^{99}Mo$). Although about 50 times as much $^{239}Pu$ is generated with 20% enriched LEU as compared to HEU for a given amount of $^{99}Mo$ produced, the additional alpha emitter production is negligible compared to the alpha emission of $^{234}U$ present in both LEU and HEU. The ratio of $^{234}U/^{235}U$ is approximately the same for both LEU and HEU. See Richard Coats, Edward Parma, and Milton Vernon, "Requirements for a Commercial-Scale Domestic Mo-99 Supply", *Transactions of the American Nuclear Society,* 2009 Annual Meeting, Atlanta, Ga., Jun. 14-18, 2009b.

Preferably, a nuclear reactor system is designed exclusively for commercial medical isotope production, be low power and passively safe, and based on proven technology. Multi-purpose usage of reactors used for current $^{99}Mo$ production conflicts with the primary goal of medical isotope production and introduces risk of outages. The unnecessary complexity of multi-use reactors also increases outage risk and cost. Finally, a single-use reactor can have more flexibility in configuration and design to accommodate technological evolution. The reactor should have a simple design and use LEU. It should be a low power reactor to minimize the radiation source, fuel burn-up, and fuel fission product inventory. The reactor should comprise a passively safe cooling system, with negative temperature and void reactivity feedback. Therefore, it should not need an emergency cooling system. Preferably, the medical isotope production facility co-locates the reactor, hot cell facility processing, and interim waste storage. To facilitate target handling, it should have readily accessible and coolable irradiation space and be compatible with remote handling of radioactive packages. The hot cell facility should be dedicated and have excess capacity, accommodate remote processing equipment removal and replacement, have robust shielding capability greater than $10^6$ Ci, have flexibility to adapt to evolving technology, and have ready access to a shielded waste storage area. The facility is preferably sited a reasonable distance from population centers, but near a major commercial airport to enable timely delivery of medical isotopes to patients.

These requirements raise a number of reactor and processing issues that should be considered in the design of an integrated medical isotope production facility, including target design, accessible irradiation space for targets and cooling, target cooling capability, irradiation time (which depends on specific activity and purity—too long an irradiation time leads to quality issues), remote/shielded retrieval an transport to processing (greater than $10^6$ Ci HCF shield capacity), interim waste storage (about 6 months), product shipping (20WC casks or equivalent), waste shipping and disposal (B2 equivalent casks), and operations staffing.

The medical isotope production facility of the present invention satisfies these requirements. As described below, the facility comprises an open pool-type reactor, current technology uranium fuel pins and targets, LEU fuel/target pins (the fuel and target pins are interchangeable), pin pitch selected to give negative temperature and void reactivity coefficient (i.e., power coefficient), adequate water channel volume for cooling, minimum driver fuel, natural convection cooling, and a water channel connecting the reactor pool to a co-located processing hot cell.

Open Pool-Type Reactor and Fuel Pin Configuration

An open pool-type reactor offers the greatest flexibility in target inventory management (shielded retrieval, replacement, and transfer) and provides inherent passive safety features that lower the safety and operation interruption risk. FIG. 1 is a side-view schematic illustration of an exemplary medical isotope production facility 10 comprising a nuclear reactor 14 in a water pool 11, a transfer pool 12, and a hot cell facility 13. The reactor 14 can be submerged in the water pool sufficiently deep to afford personnel shielding and of sufficient diameter to assure ample water for passive natural circulation cooling. A pool cooling loop 15 to a plate-type heat exchanger and secondary loop with an external cooling tower (not shown) can maintain a low pool water temperature. The reactor 14 comprises LEU fuel pins that are also the targets for $^{99}Mo$ production. Therefore, fuel and targets are one in the same. Since the fuel pins and the targets are one and the same, they are referred to hereinafter as fuel/target pins, target/fuel pins, fuel, targets, fuel or target pins, or simply pins. The fuel/target pins are irradiated in the reactor 14, transferred under water through the transfer pool channel 12 to the hot cell facility 13, and chemically processed to extract the $^{99}Mo$ in the hot cell. The hot cell can also be used for QC sampling, product packaging, and waste handling, packaging, and storage until subsequent disposal.

Figure 2:
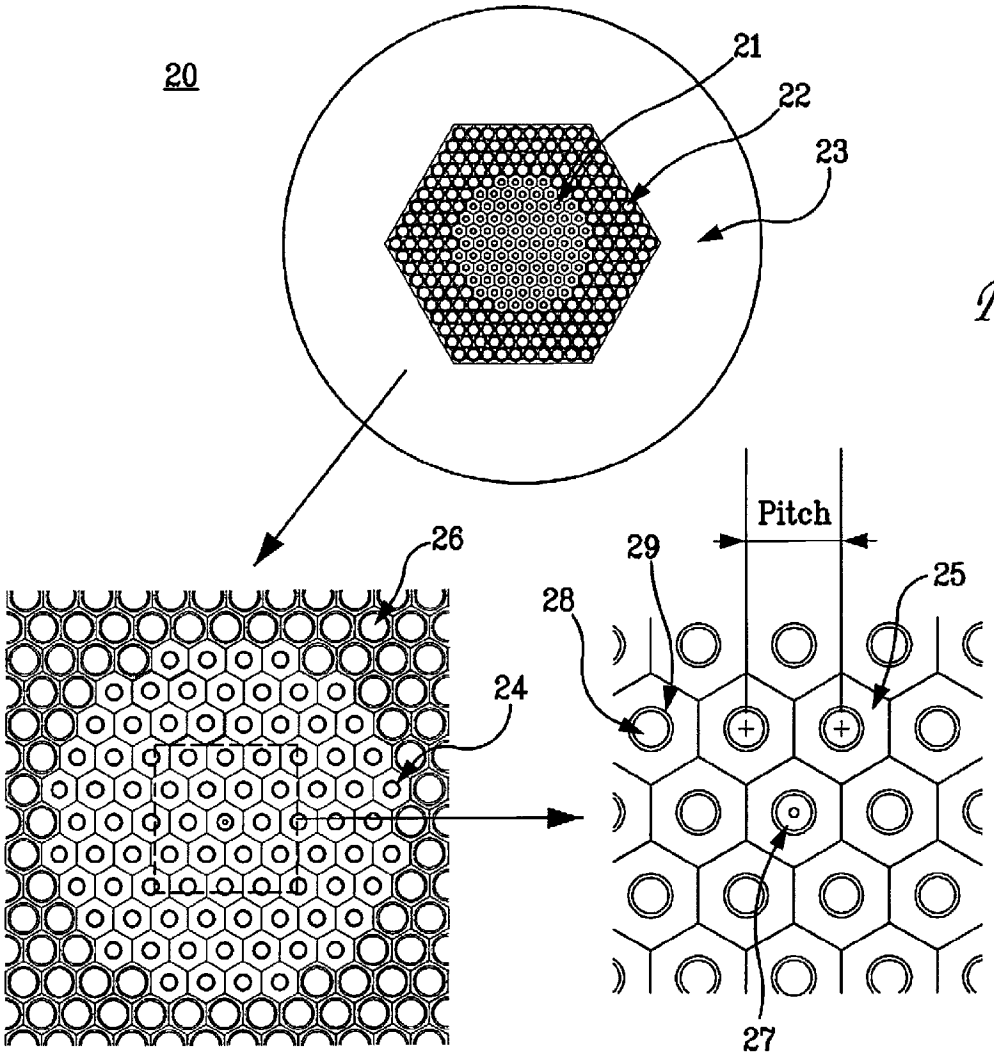
FIG. 2 is a schematic illustration of exemplary open pool-type reactor configuration comprising fuel/target pins in a triangular lattice configuration.

FIG. 2 is a top-view schematic illustration of an exemplary open pool-type reactor configuration. The reactor 20 comprises a reactor core 21, a neutron reflector 22, and a water pool 23. The reactor core 21 comprises fuel/target pins 24 arranged in a triangular configuration. An adequate number of fuel/target pins 24 must be present to allow for a critical condition at the operating temperatures of the fuel and water moderator coolant 25. Additional reactivity can be used to overcome fission product poisoning and burn up. Reflectors 26 can be used to minimize the number of fuel pins required and the non-uniformity of the radial power distribution. Reflector options include water, graphite (C), beryllium (Be), beryllium oxide (BeO), and nickel (Ni). The reflector preferably comprises C, Be, or BeO. Monte Carlo N-particle (MCNP) transport code calculations can be performed to optimize the reactor configuration. The code can be used to configure the reactor to have a sufficiently negative reactivity feedback such that it cannot run away and the reaction is always self-limiting. See *DOE Fundamentals Handbook: Nuclear Physics and Reactor Theory*, U.S. Department of Energy, January 1993, which is incorporated herein by reference. Rapid fuel temperature negative reactivity feedback is provided through Doppler effects in the fuel and spectral and density effects in the moderator. The fuel element pitch (distance between fuel/target pin centers) and surrounding reflector can be selected such that reactivity feedback coefficients are negative. A larger pitch can allow for a smaller number of fuel pins in the core; a smaller pitch can allow for a more negative reactivity feedback but additional fuel elements. The pitch can be calculated using the Monte Carlo analysis to optimize spacing, for the given pin radial dimensions and fuel density, and to minimize fuel requirements, while still assuring a robust negative water temperature/void reactivity feedback coefficient. For this core the center region 27 is a void that can be used for a safety rod. Control rods can be placed in the reflector region 22 around the core 21. The control and safety rods are moveable (up and down) and can be loaded with a neutron absorber (poison) such as boron carbide ($B_4C$). The core maintains a large negative reactivity temperature coefficient and enough excess reactivity to operate at full power conditions.

Each fuel/target pin 21 comprises LEU (20% enriched) fuel 28 surrounded by a cladding 29. A variety of fuel options can be used in the reactor. Fuel/target pin fabrication can be based on existing light water reactor (LWR) fuel fabrication processes. Oxide or metal fuel forms can be used, with the preferred option being oxide. Oxide fuel is also compatible with the Cintichem $^{99}$Mo extraction technology. Cladding materials can be zirconium alloys, stainless steel, or aluminum, with the preferred option being Zircaloy. Therefore, the fuel form preferably comprises oxide fuel-stacked pellets in Zircaloy cladding, similar to LWRs. Other options for fuel form include packed beds, internally coated cladding, or foils internally pressed onto the cladding wall.

The exemplary core configuration in FIG. 2 comprises 86 fuel/target pins that are 30 cm in length. In this example, the pitch is about 2.6 cm. The fuel element radial dimensions correspond to those typical of LWR fuel. For this example, the outside radius of the oxide fuel is 0.413 cm. The pin comprises 160 g $UO_2$ and 32 g $^{235}$U. The $UO_2$ density was 10.3 g/cc. This example uses Zircaloy cladding. The pin power in this example is 10 kW each. The core is surrounded by BeO reflector elements. The fuel region has a diameter of about 26 cm (10 in.). This core represents one of the smallest in size and number of fuel pins.

Figure 3A:
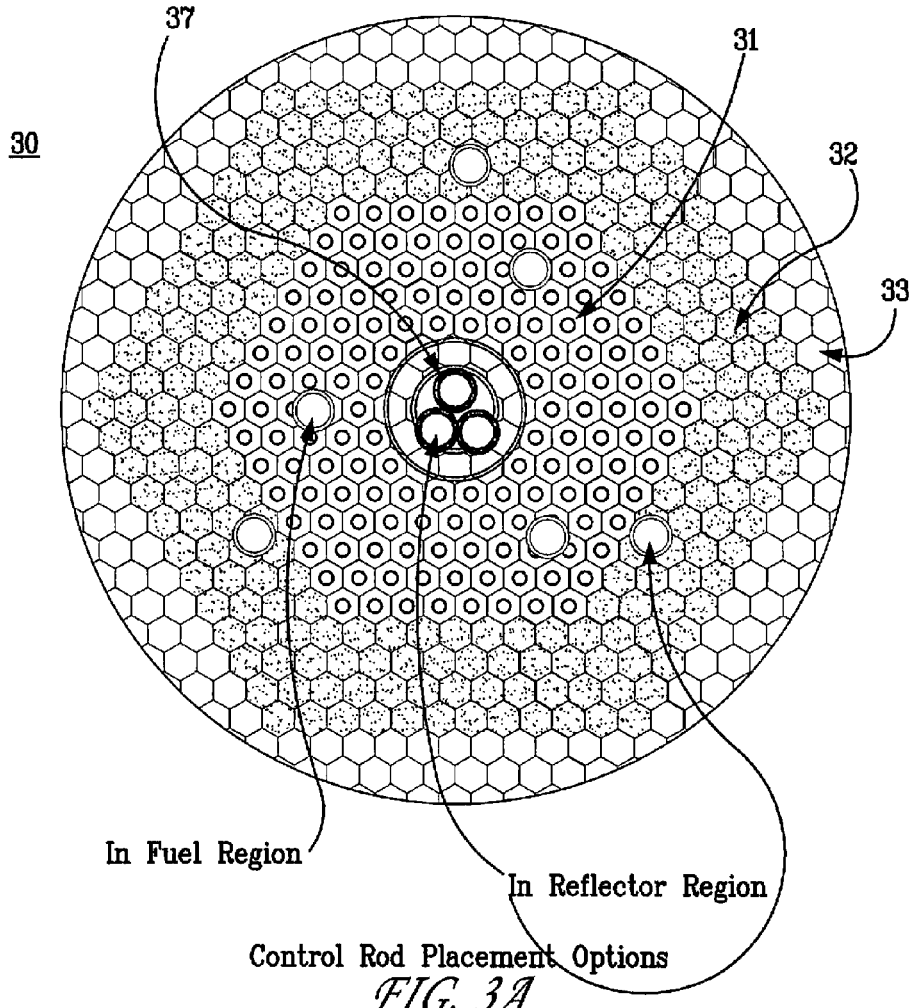
FIG. 3 is a schematic illustration of an alternative open pool-type reactor configuration comprising fuel/target pins with a central unfueled region.
Figure 3B:
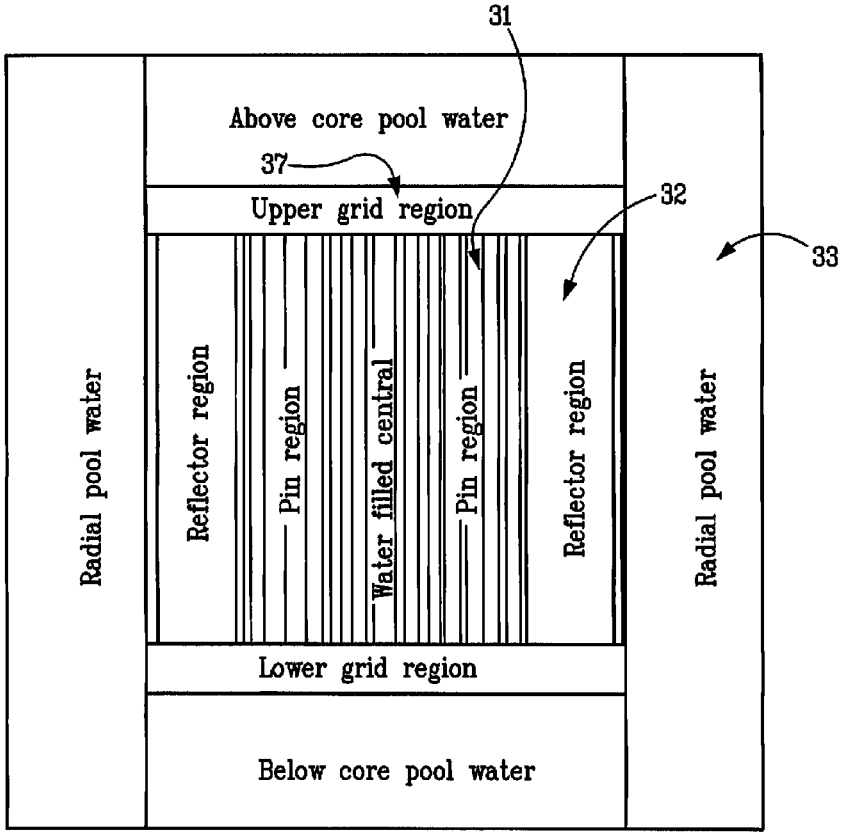
Figure 3C:
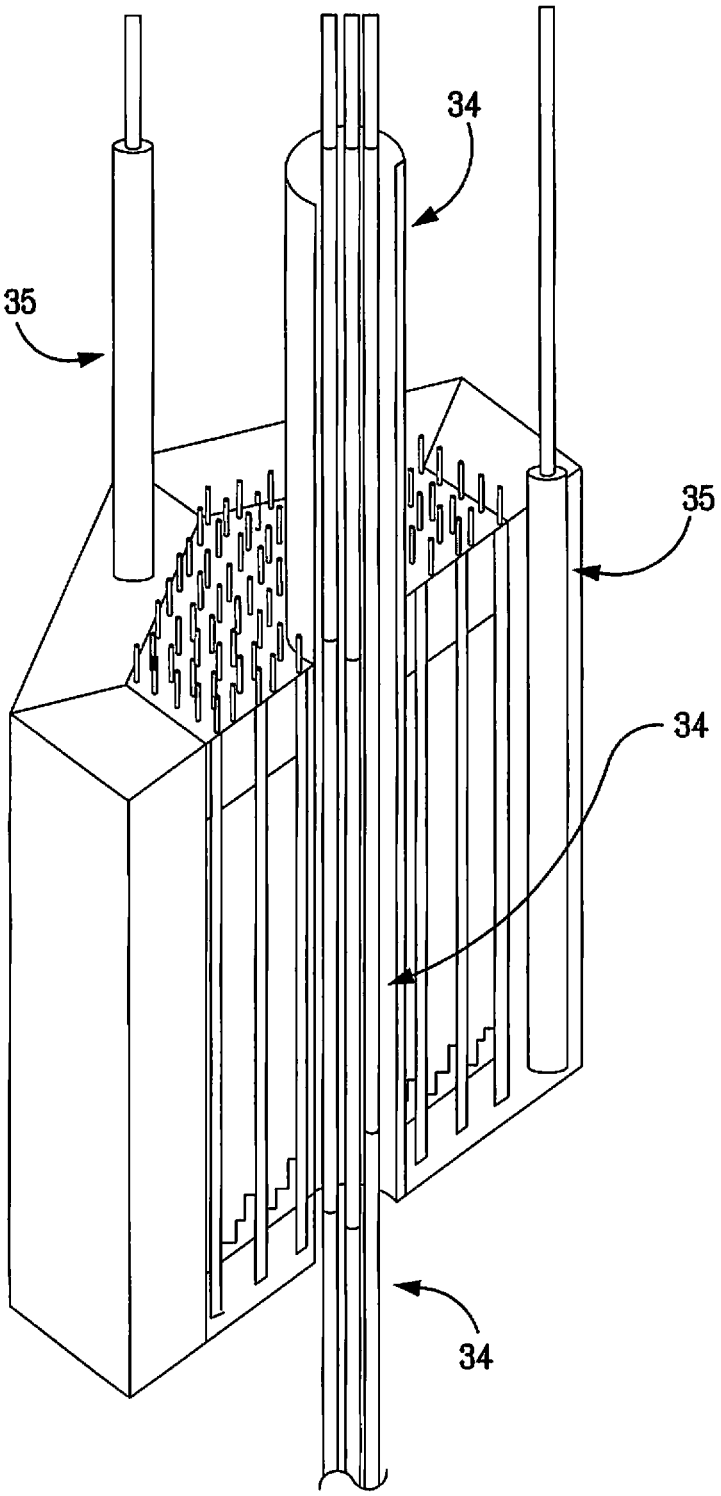

Alternatively, the inner target rows can be replaced with a central un-fueled region constructed of a neutron-absorbing material, such as stainless steel. FIG. 3A shows a top-view schematic illustration of an MCNP model of a reactor 30, comprising a reactor core 31, a neutron reflector 32, and a water pool 33, wherein the three inner target rows are replaced with a central un-fueled region 37. A side-view illustration is shown in FIG. 3B and a cut-away perspective view is shown in FIG. 3C. The central cavity region 37 provides an effective area for safety 34 or control rods 35. The neutron absorbing liner serves to "flatten" the radial power profile across the fuel/target rows. Flattening the profile minimizes the power variation in the fuel/target pins and precludes the need to shuffle the pins in order to obtain a consistent power history during the irradiation cycle.

Thermal-Hydraulics

Figure 4:
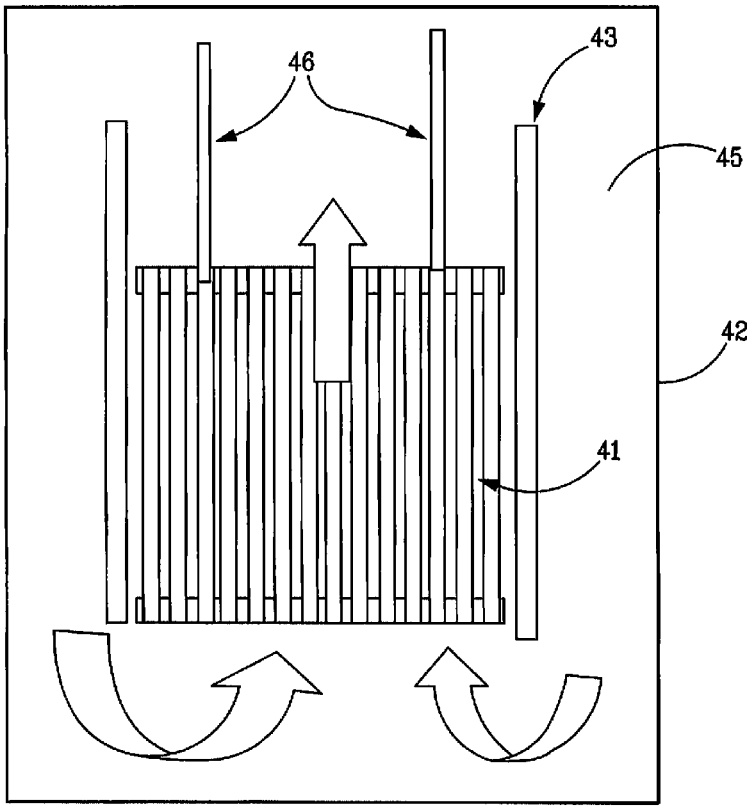
FIG. 4 is a schematic illustration of a reactor wherein the reactor fuel pins are cooled by natural-circulation flow through the core.

The core can be cooled by natural convection or by forced convection. The simplest approach for cooling the reactor fuel pins is by natural-circulation flow through the core, as shown in FIG. 4. The coolant 45 can be water in a tank (pool) 42 with the reactor core 41 at the bottom of the tank. For example, the tank can be 20 to 30 ft deep. As the water is heated in the channels between the fuel pins, the water density decreases, inducing flow through the core (bottom to top) without the use of pumps. A small (e.g., 2 MW) heat exchanger to a secondary water heat rejection system (not shown) can be used to remove heat from the water coolant. No emergency core cooling capability or backup power supply is needed for the reactor. The water channel volume of the pool can be configured so that it is sufficient for cooling to prevent damage to the core. For example, the pool water temperature can be maintained at 40-60° C. so that the pins remain at a safe temperature of about 1200° C. or less.

Natural-circulation flow for an open pool was examined as a function of fuel pin power and compared with the limits of coolability, namely the critical heat flux (CHF). This analysis indicated that, for an inlet temperature of 40° C. in a 30 ft water pool, the fuel pin CHF is about 250 W/cm$^2$ (24 kW per fuel pin) without a chimney, and about 400 W/cm$^2$ (38 kW per fuel pin) with a hydraulic chimney 43 to enhance natural-circulation flow. A limitation on peak fuel pin power is likely due to power drop-outs and oscillatory behavior as significant subcooled boiling begins, causing chug flow in the coolant channels. However, it is estimated that 30 cm fuel pins are capable of being operated in excess of 10 kW each (~100 W/cm$^2$), with a maximum centerline fuel temperature of about 1200° C. Forced cooling can be used to increase target power and lower waste, but at the expense of passive safety and simplicity. Alternatively, smaller pins and/or fins can be used.

Chemical Processing of Fuel Pins

In order for processing to be efficiently performed, the reactor and the hot cell processing facility are preferably co-located, and more preferably attached to each other, with minimal transfer constraints, as shown in FIG. 1. When the fuel/target pins are removed from the reactor core for processing, the pins contain tens of thousands of curies of fission products. Sufficient shielding of the pins must be provided in the transport to the hot cell processing facility to ensure acceptable radiation levels. The present invention can use a simple transfer pool channel that is deep enough to allow for radiation shielding while maintaining a simple transfer approach. Automated and easily maintainable hardware can be engineered for target pin dissolution, extraction, purification, QC, and waste processing.

The steps involved in processing a fuel/target pin can be as follows:

1. After the required operating cycle, the reactor is shut down. The control system can be used to place the reactor in the subcritical condition using the control rods.
2. A specified number of fuel/target pins is removed from the core. A special handing tool can be used to remove the fuel/target pins from the core grid and place them in a storage basket in the transfer channel.
3. The removed fuel pin locations in the core are loaded with fresh fuel/target pins.
4. The reactor is restarted and restored to full power operation.
5. The irradiated fuel/target pins are moved to the hot cell transfer station. The basket holding irradiated fuel pins is moved under water in the transfer channel pool from the reactor facility to the co-located hot cell facility. The first cell in the hot cell facility is a transfer station that allows for removal of the fuel/target pins from the transfer channel into the shielded cell.
6. The irradiated fuel/target pins are moved from the transfer station to the dissolution cell for initial separation of the $^{99}$Mo.
7. The irradiated fuel/target pins are opened and the fuel pellets removed and processed using the Cintichem or other extraction process.
8. Separated $^{99}$Mo solution is moved to a purification cell. All other materials are moved to the waste processing and handling cell.
9. The $^{99}$Mo solution is purified and prepared for shipping. A QC sample can be drawn from the product.
10. The QC sample can be analyzed.
11. The $^{99}$Mo product is placed in a Department of Transportation (DOT) shipping container and sealed. The QC results and the shipping manifest are prepared.

12. The $^{99}$Mo product shipping container is picked up by the freight transportation company and shipped to the customer.
13. The liquid waste is solidified and loaded with cladding and glassware into a waste drum.
14. The waste drum is stored in a shielded storage area until filled with the required number of waste hardware solids.
15. The waste drum is sealed when filled and stored for decay in a shielded storage area.
16. After a decay period (6 months to 1 year), the waste drum is sent to the disposal site in a DOT shipping cask.

Processing fuel pins to extract the $^{99}$Mo can be performed on a regular schedule dependent on the customer's requirements. One or several fuel pins can be removed at each cycle. The reactor can also be shut down for fuel pins to be removed and then restarted many times during the day, if desired. The removal of targets after a 7 to 21 day irradiation cycle precludes the build-up of a significant radionuclide inventory in the reactor core. Since the half-life for $^{99}$Mo is 66 hours (2.75 days), the time between removal of the target pin from the reactor and receipt of the $^{99}$Mo product at the customer's facility is preferably minimized. Approximately 1% of the $^{99}$Mo product decays every hour. Typically, the time required to process and ship the $^{99}$Mo product to the customer is one to two days. For a two-day processing and shipping time span, 40% of the $^{99}$Mo product has decayed from the original quantity produced in the reactor. For a one-day time span, 22% of the $^{99}$Mo product has decayed.

The oxide fuel form is compatible with the well-developed Cintichem process to separate the $^{99}$Mo. Although the Cintichem process was developed for HEU fuel, the efficiency or effectiveness of the process is similar when using LEU fuel. See "Medical Isotope Production Without Highly Enriched Uranium," National Research Council, ISBN: 0-309-13040-9 (2009). Using 20% enriched fuel, there is about five times more uranium that needs to be dissolved in the dissolution step of the process. The volume of the dissolution cocktail for a 30 g uranium target using the Cintichem process is about 100 ml. For the exemplary fuel/target pin design above, approximately 160 g of uranium is required to be dissolved, equal to about 500 ml of dissolution cocktail. This amount of generated liquid waste is very manageable. The volume of the dissolution cocktail depends on the solubility of the uranium compound in the solution.

The waste generated for a fuel/target pin includes the fuel cladding, glassware, filter columns and liquid waste with the dissolved uranium fuel. The liquid waste can be solidified into a concrete form contained within a small steel vessel. The volume of waste per target can be on the order of two gallons (~8 liters) or ~0.25 ft$^3$. The waste can be placed into a 55 gallon drum. At least 25 targets, as waste, can fit within one 55 gallon drum. When the drum is filled, it can be sealed and stored in a shielded storage area for later disposition.

The fuel/target pin processing described assumes that the liquid waste products are solidified and stored for later disposition at a disposal site. No reprocessing is assumed. However, the uranium can be separated in the waste stream, purified, and sent to a fuel fabrication facility for reprocessing.

Product Specifications

Two of the most important $^{99}$Mo product specifications include the $^{99}$Mo specific activity ($^{99}$Mo activity/total mass Mo) and the alpha emitter specific activity. The $^{99}$Mo specific activity varies with the irradiation time of the fuel/target pin. The $^{99}$Mo specific activity is 10,000 Ci/g Mo for a 7-day irradiation cycle, with 8-day decay (2 days for processing and shipping and 6-day decay period), 6,000 Ci/g for a 14-day irradiation cycle, and 4,000 Ci/g for a 20-day irradiation cycle. It is preferable that the specific activity exceed 1,000 to 5,000 Ci/g Mo for a 6-day Ci.

There are approximately 50 times more alpha emitting actinides generated using LEU fuel compared to HEU fuel due to the $^{238}$U in the fuel. This should not, however, affect the product quality since the alpha emitting isotope that dominates this effect is $^{234}$U. The fuel would be required to be irradiated over 50 days before the alpha activity from actinide production would exceed the $^{234}$U activity. The efficiency of the Cintichem process also maintains the alpha activity in the product to very low levels. The product specification for the alpha activity is $1\times10^{-7}$ μCi-α/mCi-$^{99}$Mo.

Other $^{99}$Mo product quality specifications include the gamma activity for $^{131}$I, $^{103}$Ru, $^{108}$Rh, $^{132}$Te, and $^{112}$Pd, total gamma activity, and beta activity for $^{89}$Sr and $^{90}$Sr.

Medical Isotope Production Capacity

As noted above, the domestic demand for $^{99}$Mo is about 6,000 six-day Ci per week. $^{99}$Mo is generated by the fission process at the rate of 0.061 atoms of $^{99}$Mo per fission. This translates to a saturated activity of 51.4 Ci per kilowatt of target power. Using a half-life of 2.75 days (66 hours) for $^{99}$Mo, a 7-day target irradiation will reach 82.9% of the saturated activity (42.6 Ci/kW); a 14-day target irradiation will reach 97.1% of the saturated activity (49.9 Ci/kW).

Figure 5:
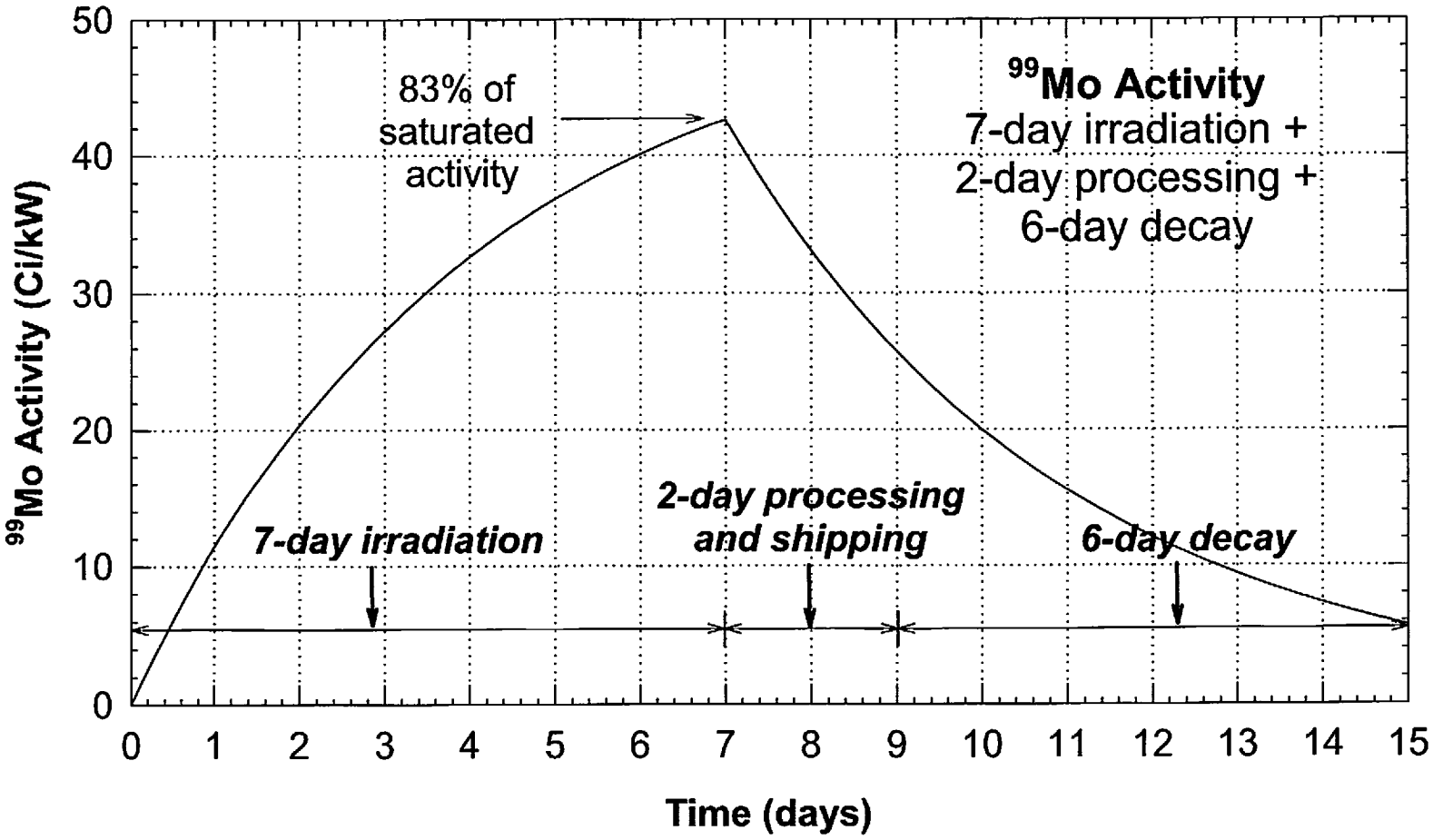
FIG. 5 is a graph of the activity (Ci) of $^{99}$Mo per kilowatt as a function of time for a 7-day Irradiation with a 2-day processing and shipping period and a 6-day decay period.

The $^{99}$Mo activity in units of Ci/kW as a function of time is shown in FIG. 5 for a 7-day target irradiation with a 2-day time period for processing and shipping and a 6-day decay period. The activity at the end of the 6-day decay period is what is known as the 6-day curie. It represents the quantity of $^{99}$Mo that is invoiced to the radio-pharmaceutical customer. For this irradiation time and processing and shipping time, the number of 6-day curies produced is 5.66 Ci/kW. Decreasing the processing and shipping time by one day increases the $^{99}$Mo activity by ~29%. Therefore it is desirable to minimize the processing and shipping time in order to maximize the profitability of the $^{99}$Mo process.

The quantity of the $^{99}$Mo produced in the fuel/target pins is directly proportional to the power generated in the pin. Assuming an average pin power of 10 kW, the reactor power is 1.25 MW for a 125 element core, well in excess of the required target power to satisfy the U.S. demand for $^{99}$Mo. Approximately 1 MW of continuous target fission power with daily extraction and processing is necessary to meet the domestic $^{99}$Mo demand. To meet the demand with two days allowed for processing and shipping, approximately 16 fuel/target pins would be extracted and processed daily. Operating at higher pin power levels would reduce the number of pins processed per day and, concurrently, the total waste produced. Optimization of the chimney enhancement of natural-circulation flow can provide higher limits on fuel pin power than the assumed 10 kW. Even higher power limits can be achieved by use of cooling fins on the pins. The pin power is ultimately limited by the heat flux from the pin and/or the centerline temperature of the fuel pellet.

The target region can be increased or decreased, depending on the $^{99}$Mo production demand. Operation at 20 kW of average pin power would yield greater than 200% of domestic demand. At an average pin power of 20 kW (total reactor power ~2.5 MW) only 3 or 4 targets need be processed per day. Only about 28 grid positions are sufficient for a 7-day irradiation cycle and the remaining 90 grid locations can contain driver fuel pins differing from $^{99}$Mo target pins only in the reactor residence time. Alternatively, for any production level short of 100% domestic demand, there are more irradiated targets present in the core than are required to be processed. For production of 30% demand, 38 fuel/target pins are required to be processed per week at a fuel pin power level of 10 kW. The remaining pins can be designated driver pins and/or processed after longer irradiation times to optimize the production of long-lived non-$^{99}$Mo isotopes for medical or industrial applications. The pins can also be cycled on a period of longer than seven days, as long as the product specifications for purity can be met. A 21-day irradiation cycle can be possible, allowing for more of the fuel pins to be processed in the core.

Such excess driver pins can be a source of other longer lived isotopes of medical or industrial interest. Some examples of other isotopes produced by fission that can be extracted for medical or industrial applications include $^{131}$I, $^{133}$Xe, $^{140}$Ba/$^{140}$La, $^{141}$Ce, $^{144}$Ce, $^{147}$Nd, $^{95}$Zr/$^{95}$Nb, $^{103}$Ru/$^{103m}$Rh, $^{105}$Rh $^{153}$Sm, $^{89}$Sr, $^{91}$Y and $^{147}$Pm. The driver pins can also provide a source for industrial isotopes such as $^{85}$Kr or $^{147}$Pm. For example, $^{147}$Pm can be produced through the activation of Nd. Some fission product isotopes, such as $^{147}$Pm used in micro-batteries, may be better suited for long-term pin irradiations, since they have longer half-lives. However, the longer irradiation times may lead to quality problems such as low specific activity and higher concentration of undesirable radionuclide impurities. Activation production of other useful isotopes can be accomplished using pin locations outside the core grid location.

Medical Isotope Production Facility

Figure 6:
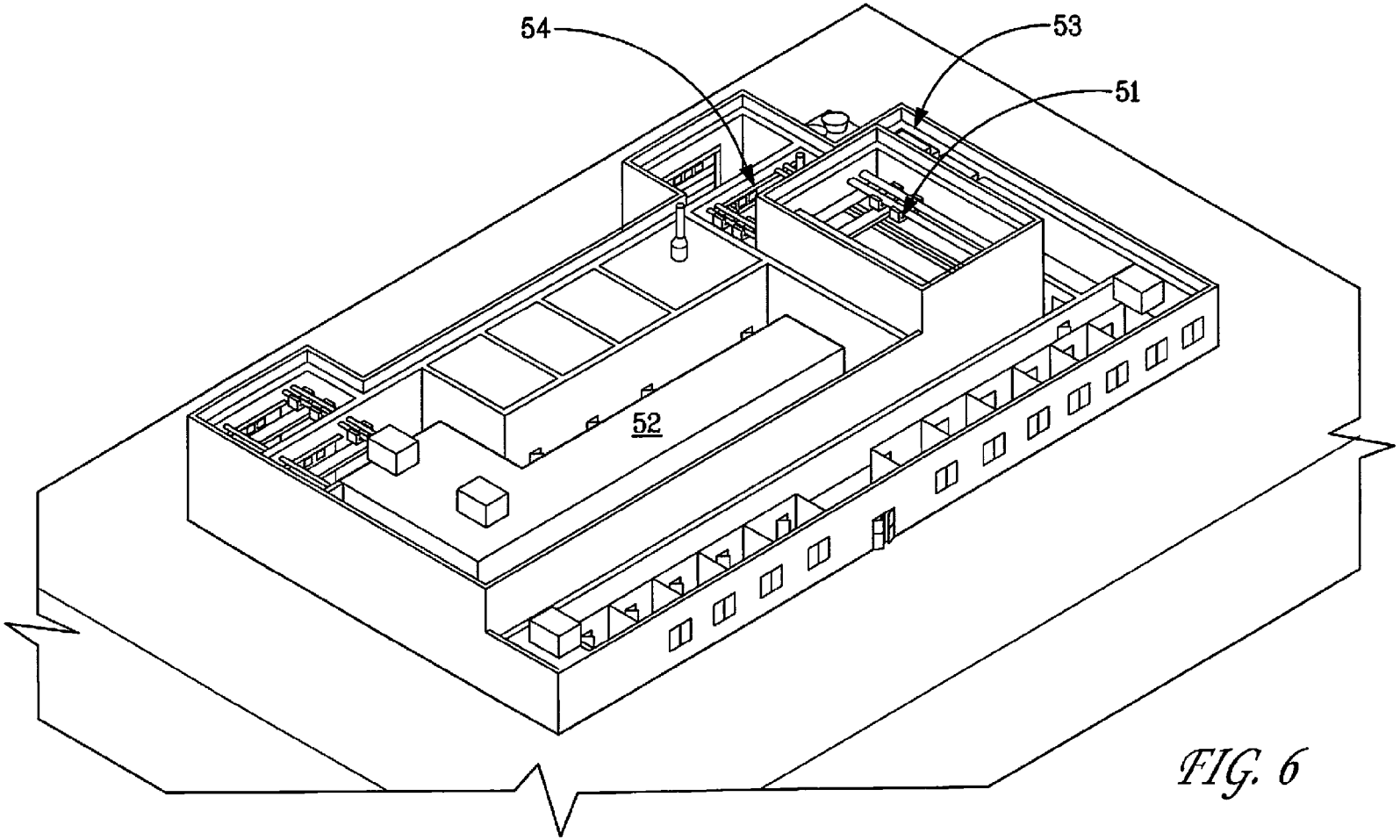
FIG. 6 is a plan view schematic illustration of an exemplary medical isotope production facility.

FIG. 6 is a schematic illustration of an exemplary medical isotope production facility comprising a reactor area 51 and a hot cell facility 52. The reactor area can include a high bay, equipment room, control room, and storage area. The reactor high bay can have a small footprint of about 30 ft by 40 ft and be about 30 ft in height. This includes a crane, ventilation system, makeup air supply, and a roll-up door for access to an external truck ramp. The walls of the reactor high bay do not require shielding, since the transfer of irradiated pins can be performed under water. The reactor pool, transfer pool channel, storage pools, and storage pits can be located within the reactor high bay. The secondary heat exchanger and pump, as well as the water makeup and clean-up systems can be located within an equipment room 53 next to the reactor high bay. Fresh fuel/target pin storage can be located within an auxiliary room 54 next to the reactor high bay. The reactor can be operated from an adjacent control room.

The pool tank can be cylindrical and about 30 ft deep. The tank can be constructed from stainless steel and can be about 10 ft in diameter. The top of the tank can be either at ground level or extend a few feet above ground level. The control system drives can be located on a bridge on the top of the pool tank. The water in the tank can be de-ionized and maintained using a clean-up system located in the equipment room. There are preferably no penetrations in the tank wall except for the transfer pool channel, which can be integrated with the tank but not extend to the bottom of the tank.

The pool water can be cooled by using a plate-type heat exchanger and pump located in the equipment room. Stainless steel piping can be used for the pool cooling outlet pipe that can extend to about 6 ft below the pool surface, as well as for the pool cooling inlet pipe that can extend to the bottom of the pool. The secondary water can flow through the secondary side of the heat exchanger through piping in the high bay wall, to a small 2 MW cooling tower located outside and adjacent to the building.

Irradiated fuel/target pin handling can be performed using automated or manual handling tools that remove pins from the reactor grid with the reactor shut down and place them in a basket at the transfer channel. The empty locations in the reactor grid can be filled with fresh fuel pins in a similar manner. The transfer channel can be a stainless steel-lined trough about 1 ft wide and about 12 ft deep. It can extend from the pool tank to the first shielded cell of the hot cell facility. The irradiated fuel/target pin basket can be moved through the transfer channel to the first cell of the hot cell facility, where the irradiated pins can be removed from the basket using manipulators and prepared for processing.

Separate ventilation systems can be maintained for the reactor area and the hot cell area. A separation wall between the areas can maintain the ventilation separation between the areas. The reactor does not require containment, since the fission product inventory is low and the large volume water pool acts to retain any volatile fission products that would be released in an accident. Each ventilation system can maintain filtered exhaust prior to release to the environment.

The hot cell facility can be used for $^{99}$Mo processing, purification, QC analysis, product packaging and shipping, waste processing, waste handling and storage, and waste shipping. The hot cell bay can incorporate redundant processing lines to allow for backup with capacity for greater than 100% of the domestic demand for $^{99}$Mo. The cells can be constructed with thick concrete walls for shielding and can include stainless steel processing boxes, shielded windows, manipulators, and ventilation filters. The processing boxes can include the necessary equipment to perform the task for that box, e.g., fuel removal and dissolution, product purification, waste handling and solidification, and product packaging.

Process waste can be stored in a large shielded region at the end of the hot cell bay. Waste storage capacity can be provided for at least one year at 100% of the domestic demand. Waste can be contained in 55 gallon drums and stored on a conveyer system. The drums can exit into a shielded room after the required decay period (at least 6 months) and shipped to a disposal site using a DOT shipping cask.

Ventilation can be controlled in three zone volumes in the hot cell facility. A first zone can be the ventilation control volume within the stainless steel processing boxes. A second zone can be the control volume within the shielded concrete structure (hot cell bay) and waste storage area. A third zone can be the control volume within the remaining region of the hot cell facility, including the area inhabited by the operating staff. The second zone can be maintained at a lower pressure than the third zone, and first zone at a lower pressure than the second zone, to ensure that airflow would always be from the non-contaminated volume of the third zone to the potentially highest contaminated volume of first zone. Each of the zones can have its own filtration and ventilation system equipment. The exhaust from the facility can be routed through a stack located outside the facility. The ventilation system can be designed to minimize radioactive releases to the environment. The releasable quantities are established through the NRC, Environmental Protection Agency (EPA), and local agencies.

Auxiliary rooms can include a storage area for fuel/target pins, chemicals, and miscellaneous equipment. Fume hoods for chemical preparation and QC can also be included in auxiliary rooms. Office space can be located outside of the reactor and hot cell facilities but within the same building structure and can maintain its own ventilation, heating, and cooling system. The facility can meet the seismic requirements for the NRC at the site location. The facility footprint can be approximately 20,000 square feet. An office area can cover about 15% of the building area. The reactor area can cover about 25% of the building area. The hot cell facility, including the hot cell processing lines, waste storage area, waste shipping area, chemical preparation labs, QC lab, and product shipping area, typically covers the majority of the building area.

Facility Siting and Safety

The facility can be sited at a variety of locations due to the relatively low hazard classification and fission product inventory. It is desirable that the site be near a major airport to allow for minimal shipment times, but not essential if major airports are only a few hours away by ground transportation, or if cargo or chartered flights can be made through the local airport that can carry the DOT-approved, shielded-product shipping container. If the facility produces in excess of 20% of the domestic demand for $^{99}$Mo, radiopharmaceutical companies can build and operate $^{99}$Mo generator plants nearby. This minimizes the transportation requirements and lessen the timing demands for the process.

The non-pressurized pool-type reactor system of the present invention is inherent safe. Passive structures and the water pool are the main barriers providing protection for the workers and the public from accidents involving fuel pin cladding failures. Since the reactor can operate at a low power level of only 1 to 2 MW, and a significant fraction of the fuel/target pins can be replaced regularly with fresh pins, the fission product inventory, or source term, in the reactor core can be relatively low. Fission product source term buildup is low, due to the low power operation of the reactor and the removal and processing of the pins on a regular basis. Operating to supply 100% of domestic demand implies that all fuel is processed after 7 to 14 days of irradiation, which results in a very low core fission product inventory source term. Since the reactor is operated in a large water pool, the release of fission products from accidents involving ruptured fuel pins would be limited to mostly noble gases, due to water scrubbing of the halogens and other volatile fission products.

The temperature, void, and power reactivity coefficients for the reactor are strongly negative, giving the core the feature of self-regulation of power and inherent shutdown in over-power or over-temperature unplanned events. The cooling requirements for the low steady-state power level, and thus individual pin power, are adequately satisfied by inherent natural-circulation cooling. Forced cooling of the core is not required. Therefore, failure of the primary pool pumps, mechanical or electrical, is not an issue for the reactor. The reactor shuts down automatically with loss of electrical power. The electromagnetically-coupled control and safety rods can drop into the core after a loss of electrical power, adding negative reactivity and shutting down the reactor. Since the core is cooled by natural-convection cooling, decay heat removal is also accomplished through natural-convection cooling to the reactor pool, which again has a very large heat capacity. Decay heat generation in the core after shutdown is also low. The reaction time required for addressing pool cooling system problems is quite long (tens of minutes) due to the heat capacity of the pool water. An emergency core cooling system or an emergency backup power system is not needed. Backup power for instrumentation is desirable, but not necessary. The safety protection/control system can be simple and straightforward, directed at controlling reactivity and power level by adjusting the control rod positions. Control console instrumentation can be used for monitoring the neutron/gamma flux (reactor power), pool temperature, and radiation sensors.

The co-located hot cell facility can have only a few fuel/target pins in process at one time. Hence, the source term for accidental release from the hot cell portion of the facility will be limited. Further, the hot cell facility can have redundant zones and filtration systems to limit the releases to the public and environment under both normal and accident conditions.

The present invention has been described as a target-fueled nuclear reactor for medical isotope production. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A target-fueled nuclear reactor for medical isotope production, comprising:

a reactor core comprising a plurality of low-enriched uranium fuel/target pins for the production of a medical isotope, wherein the fuel and target pins are one in the same and wherein the pitch of the pins is selected to give a sufficient negative reactivity coefficient; and an open water pool that contains the core, wherein the water channel volume of the pool is sufficient for cooling of the reactor core.

2. The reactor of claim 1, wherein the fuel/target pins comprise uranium metal.

3. The reactor of claim 1, wherein the fuel/target pins are cylindrical or annular.

4. The reactor of claim 3, wherein the fuel/target pins have an outside diameter of less than 2 cm.

5. The reactor of claim 1, wherein the length of the fuel/target pins is less than 50 cm.

6. The reactor of claim 1, wherein the fuel/target pins comprise a triangular or square lattice configuration.

7. The reactor of claim 1, wherein the core comprises an annular configuration comprising a central structure to facilitate automated fuel/target pin extraction and replacement.

8. The reactor of claim 1, further comprises a reflector for adjustably reflecting the fuel/target pins axially and radially to provide for uniform pin power, reactivity adjustment, and enhanced negative feedback.

9. The reactor of claim 8, wherein reflector comprises water, graphite, beryllium, or beryllium oxide.

10. The reactor of claim 1, further comprising a transfer pool for connecting the water channel of the reactor pool to a co-located processing hot cell.

11. The reactor of claim 1, wherein the medical isotope produced comprises $^{99}$Mo produced as a fission product of $^{235}$U in the low-enriched uranium fuel/target pins.

12. The reactor of claim 1, further comprising at least one driver pin for the production of at least one non-$^{99}$Mo isotope.

13. The reactor of claim 12, wherein the at least one non-$^{99}$Mo isotope produced comprises $^{131}$I, $^{133}$Xe, $^{140}$Ba, $^{140}$La, $^{141}$Ce, $^{144}$Ce, $^{147}$Nd, $^{95}$Zr, $^{95}$Nb, $^{193}$Rh$_m$, $^{105}$Rh, $^{103}$Ru, $^{153}$Sm, $^{89}$Sr, or $^{91}$Y.

14. The reactor of claim 1, wherein the water channel volume is sufficient for natural convection cooling of the reactor core.

15. The reactor of claim 14, wherein the water pool comprises a hydraulic chimney.

16. The reactor of claim 1, wherein the wherein the fuel/target pins comprise a uranium compound.

17. The reactor of claim 16, wherein the uranium compound comprises $UO_2$.

18. The reactor of claim 1, wherein the power of the reactor core is less than 2.5 MW.

19. The reactor of claim 1, wherein the specific activity of the fuel/target pins is greater than 1,000 Ci ($^{99}$Mo) per gram of molybdenum.

20. The reactor of claim 1, wherein the fuel/target pins have an irradiation cycle of less than 21 days.

21. The reactor of claim 1, further comprises a reflector for adjustably reflecting the fuel/target pins axially or radially to provide for uniform pin power, reactivity adjustment, and enhanced negative feedback.

* * * * *